United States Patent [19]

Jungwirth

[11] Patent Number: 4,856,254

[45] Date of Patent: Aug. 15, 1989

[54] METHOD OF PLACING STEEL TENDONS THROUGH DUCTS IN A CONCRETE STRUCTURAL MEMBER

[75] Inventor: Dieter Jungwirth, Munich, Fed. Rep. of Germany

[73] Assignee: Dyckerhoff & Widmann Aktiengesellschaft, Munich, Fed. Rep. of Germany

[21] Appl. No.: 167,570

[22] Filed: Mar. 14, 1988

[30] Foreign Application Priority Data

Mar. 14, 1987 [DE] Fed. Rep. of Germany ..... 3708358

[51] Int. Cl.[4] ..... E04C 3/10

[52] U.S. Cl. ..... 52/741; 52/223 R; 52/230; 52/224; 264/228

[58] Field of Search ..... 52/224, 230, 223 R, 52/741; 264/228

[56] References Cited

U.S. PATENT DOCUMENTS

| | | | |
|---|---|---|---|
| 2,667,068 | 1/1954 | Viehe | 52/224 |
| 3,901,425 | 8/1975 | Taylor | 226/188 |
| 3,950,840 | 4/1976 | Dietrich | 52/224 |
| 4,067,676 | 1/1978 | Hewitt | 425/432 |
| 4,445,321 | 5/1984 | Hutchinson | 427/409 |
| 4,661,313 | 4/1987 | Schoening | 52/224 |
| 4,893,270 | 7/1975 | Schupack | 52/224 |

FOREIGN PATENT DOCUMENTS

| | | | |
|---|---|---|---|
| 1488453 | 6/1965 | France | 52/224 |

*Primary Examiner*—Henry S. Raduazo
*Attorney, Agent, or Firm*—Toren, McGeady & Associates

[57] ABSTRACT

In pulling or pushing steel tendons, such as strands of steel wire through ducts positioned in a concrete structural member, the ducts are sheathing tubes encased in the concrete of the structural member. To limit the friction acting on the tendon as it is displaced through a duct, forces acting in the axial direction of the duct or vibrations acting transversely of the axial direction of the duct are applied directly to the tendon. These forces are applied at recesses in the structural member accessible at its outside surface. The friction acting on the tendon is compensated by the axially directed forces and the application of vibrations greatly reduces the coefficient of friction. These forces acting on the tendon can be combined and are particularly useful for moving tendons around small radius curves and through large redirecting angles.

7 Claims, 2 Drawing Sheets

METHOD OF PLACING STEEL TENDONS THROUGH DUCTS IN A CONCRETE STRUCTURAL MEMBER

BACKGROUND OF THE INVENTION

The present invention is directed to a method of inserting steel tendons, particularly strands or bundles of strands of steel wire, into ducts formed in a concrete structural member, such as by encasing sheathing tubes in the concrete In erecting prestressed concrete structures, tendons are inserted either within the sheathing tubes located in the form work before the concrete is poured or are subsequently introduced into the ducts formed in the concrete structural member by encasing the sheathing tubes in the concrete. This second procedure has the special advantage in a heavy prestressing member intended for high tensioning forces, that in the preparation of form work and the installation of slack nonprestressed reinforcement of the structural member, it is necessary only to build in light sheathing tubes. Subsequently, the considerable weight of the tendons is applied and can be carried by the concrete structural member in the hardened condition.

Tendons can be placed in the prepared ducts either using a pulling member introduced before hand, that is, a so-called pilot wire or the tendons can be pushed in by appropriate pushing devices. Motor driven pushing devices including motor driven friction rollers engaging one tendon provide the pushing forces acting in the axial direction of the tendon and such devices are known.

During the pulling or pushing method of inserting the tendons into the ducts, the friction of the tendons developed at the surface of the sheathing ducts must be overcome. Overcoming the friction is relatively easy in short, generally straight tendons. Problems arise, however, when the tendon is directed around a large redirecting angle or around a tight small radius curve. It is especially difficult if tendons must be directed around a complete circle, such as in a spherical or cylindrical container.

Such a problem occurs in a pressure vessel for storing, producing or transporting compressed gases where the prestressing members are in the form of closed rings tensioned as a result of the pressure of the medium within the container causing a radial widening of parts of the container separated from one another by expansion joints.

When tendons are pulled into the sheathing ducts, the force available is reduced due to friction losses to about 30 per cent of the initial force when the tendons are moved through reversing or redirecting angles of 360° with a useful friction coefficient of 0.2. Installation of prestressing members around reversing angles larger than 360° does not appear to be possible, because of the snubbing effect developed during the pulling operation with angles of greater than 360°. When tendons are pushed into the ducts, frictional forces develop due to the continuous buckling load on the tendon and because of contact at the surface of the sheathing tubes, accordingly, pushing tendons around such redirecting angles appears to be inconceivable.

SUMMARY OF THE INVENTION

Therefore, the primary object of the present invention is to provide a method of placing tendons, particularly tendons formed by bundles of steel wire stands into ducts formed by sheathing ducts encased in concrete, especially if long tendons are installed or if the tendons have to be conducted around large reversing angles with relatively small radii.

In accordance with the present invention, recesses are provided in the concrete structural member affording access to the ducts with the recesses being accessible on the outside surface of the structural members. Additional feeding forces acting in the driving direction and/or vibration acting transversely to the driving direction are applied through the recesses directly to the tendons for overcoming or lowering the friction on the tendons conducted over considerable distances around small radius curves and/or around large reversing or redirecting angles.

The invention is based on the concept that the losses of forward feed force due to friction when pulling or pushing the curves can be compensated either by creating additional feed forces or by vibrating the tendons during the operation so that the coefficient of friction is greatly reduced. If it is possible to lower the coefficient of friction down to 0.05 by additional feeding forces or by vibration or by a combination of the two, it is possible in a pressure vessel to introduce tendons continuously possibly through three complete turns or coils so that the tension at the ends drop merely to about 40 percent of the initial force. This has the advantage in a pressure vessel that both the joint or anchorages of the tendon must not be involved is each ring, but rather only in each third ring. A pushing device engaging the tendon and a vibrator in contact with the tendon for developing vibration can be arranged in the recesses for applying additional feeding forces.

It is also essential for reducing and balancing out the friction, that the tendon ducts have an inside surface which is as smooth as possible and is uniformly curved. This can be achieved by forming the ducts out of steel tubes present continuously in the form of the required curves. The steel tube can be provided with a coating for corrosion protection as can the tendons. Such corrosion protection can be in the form of a synthetic resin and thus act without further treatment in a friction-reducing manner and also be conceived in a particularly friction-reducing manner. Tendons can also be used provided with a friction-reducing and/or corrosion preventing coating.

A particularly low coefficient of friction is important not only for the installation of the tendon conducted around large redirecting or reversing angles, but it is also important in subsequent prestressing. When prestressing bundled tendons formed of steel wire strands conducted around curves, the strands located at the bottom have, as a rule, another coefficient of friction with respect to the duct wall as compared to the strand disposed above them which are only in abutment with one another. It must be considered that the lower strands contacting the inside surface or wall of the duct are exposed to very high transverse pressure. Such stresses result often in excessive tension, in particular unfavorable circumstances that can even lead to fracture. Such danger can be considerably diminished if it is possible to provide the same coefficient friction between the strands and the duct surfaces as between the strands themselves. The above-mentioned continuously curved sheathing steel tube afford this result.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
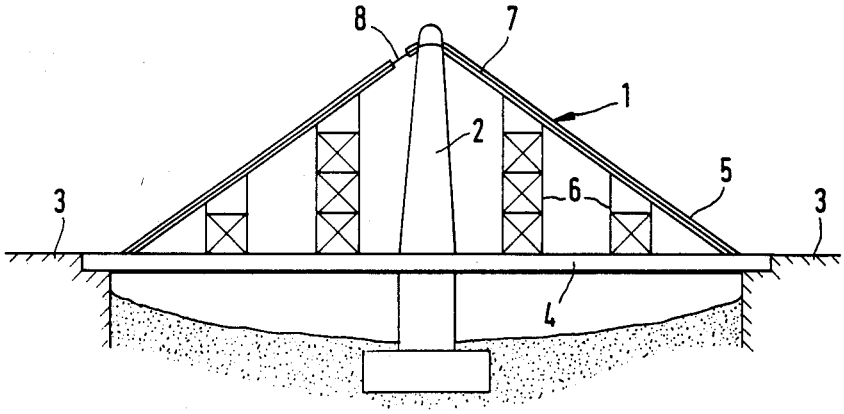
FIG. 1 is a elevational view of a structural member with very long tendons or prestressing members in the form of a diagonal cable for a stayed girder bridge.

In FIG. 1, an application of the present invention is shown in the form of a diagonal cable 1 for a stayed girder bridge. The diagonal cable 1 is formed of a plurality of strands of steel wire with the cable being redirected over the top of a pylon or pier 2 and anchored at the opposite ends of a roadway girder 4, extending between side abutments 3. In the installation of the diagonal cable 1, as shown in FIG. 1, a sheathing duct or tube 5 is placed over falsework supports 6, located intermediate the ends of the girder 4 and supported on the girder and extending up to heights intermediate the girder surface and the top of the pier 2. Individual strands 7 of the diagonal cable 1 are inserted for their entire length from one end of the girder to the top of the pier where the strand is redirected downwardly from the top of the pier to the other end of the girder. A pushing device serves for pushing the strands into the duct 5, as will be explained later in connection with FIG. 4.

To keep the frictional losses as low as possible in such a long tendon, which is redirected over the top of the pier around a relatively tight curve, a cut-out 8 is provided in the duct 5, adjacent the top of the pier 2, and an additional pushing device is placed in the cut-out to provide an additional feeding force to the strand at the cut-out. In a similar manner, a vibrator could also be arranged in the cut-out 8 to excite vibration in the strand as it is pushed through the duct. The manner in which these operations are performed will be explained later with the aid of FIGS. 4 and 5.

Figure 2:
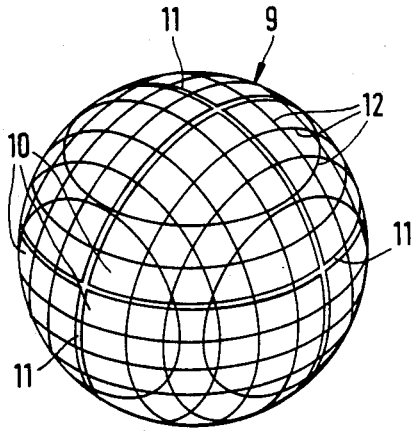
FIGS. 2 and 3 are perspective views of a spherically shaped prestressed concrete pressure vessel with tendons conducted around large reversing or redirecting angles.

The arrangement of tendons 12 in a spherically-shaped-container 9 is shown schematically in FIG. 2, where the container shell is formed of eight spherical segments 10, extending for a sector angle of 90°. The individual segments 10 are separated from one another by joints 11 extending along three great circles of the spheres. Prestressing members or tendons 12 are located in the container shell in the form of closed rings, turns or coils. The tendons are prestressed by expanding the sphere, that is, by an increase in radius and by means of the joints 11, which widen in the course of such expansion. The design of such a container 9, and its fabrication are not the subject of the present invention which is directed only to the installation of the tendons in prepared ducts.

In view of the enormous forces involved in such a structural member, bundled tendons made up of a large number of steel wire strands are required and they are arranged in a very tight spacing relative to one another. Such tendons 12 must carry high forces in the closely packed positions adjacent one another and in passing around small radii of curvature. To the extent possible, there should be no cable sag or slippage and clearly defined frictional conditions must be provided during the insertion of the tendons into the ducts as well as during the prestressing operation.

Figure 4:
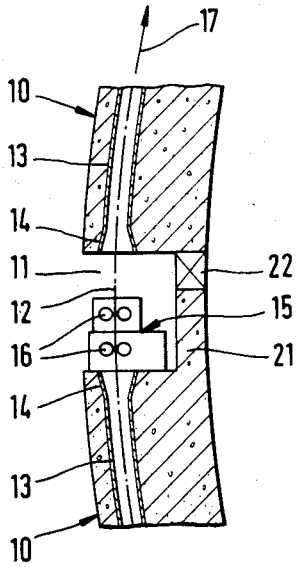
FIG. 4 is a schematic illustration of the application of additional feed forces in the installation of tendons.
Figure 5:
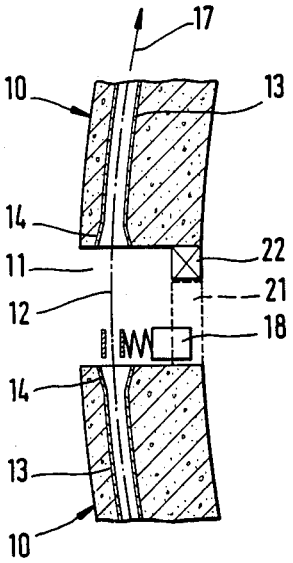
FIG. 5 is a view similar to FIG. 4, showing an arrangement for applying vibration to tendons for reducing the friction during the installation of the tendons into ducts.

In this embodiment, the joints 11 between the individual spherical segments are recesses traversing the paths of the tendons 12 and additional pushing devices or vibrators are located within the recesses for overcoming or reducing the friction during the pushing or pulling operation. FIGS. 4 and 5 show the pushing or pulling devices in a schematic manner.

In FIG. 4, a duct for a tendon is formed of sheathing tubes or ducts 13, in the upper and lower segments 10 of the container 9. The entry or exit into the duct 13 has a widened part 14 opening into the joint or recess 11. The sheathing tubes 13 are formed of continuously prebent steel tubes. The joints 11 are bridged by pieces of the duct displaceable relative to one another in a telescoping fashion, and this feature is not a part of the invention.

The strands forming one tendon 12, of which only the axis is indicated in FIG. 4 by a dot-dash line, are pushed into the duct by a so-called pushing device 15 positioned in the joints or recesses 11. Each pushing device 15 includes pairs of rollers 16 for engaging a strand and imparting a feeding force to it acting in the direction of the arrow 17. By locating several pushing devices along the path of a tendon 12 in the joints or recesses 11, traversed by the tendon, it is possible to compensate for the frictional forces of the strand in the tendon ducts 13 during the pushing operation. The frictional forces are caused by the large radius of curvature of the ducts through which the strands are pushed.

In addition to pushing the strand as described above, it is also possible to pull them by means of a pulling or traction cable previously inserted into the duct. In such an operation, preferably the strands are not pulled in individually, but rather in bundles, even several bundles disposed parallel to one another. To reduce the frictional losses in this method, vibrators 18 are located in the joints or recesses 11, note FIG. 5 where the vibrator is shown only schematically. The vibrator engages the strands or strand bundles and causes them to vibrate at right angles to the elongated axis of the strands or the ducts. Though the vibrations attenuate relatively rapidly, it can be assumed that they propagate across approximately one-eighth of a circle if they are generated in the joints 11, located in every quarter-circle, whereby the preponderant portion of the length of the tendons is exposed to the vibrating effect. In this manner, it is possible to reduce the coefficient of friction down to approximately 0.05, so that one tendon can be inserted not only around one complete turn, but around three complete turns with a tension drop of approximately 40% and without any problem due to the known snubbing effect.

Figure 3:
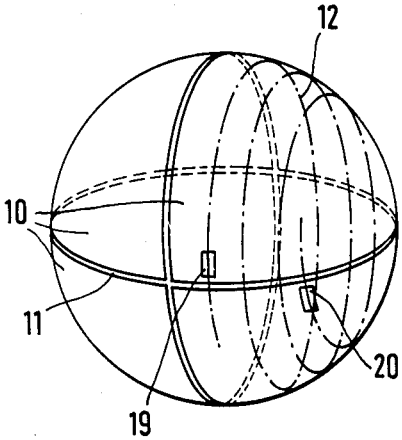

In FIG. 3, the placement of a tendon as described above is indicated schematically. A tendon 12 anchored in or joined to an anchoring device 19, extends over a total of three concentric turns to (another anchoring device 20, where it is anchored or joined with another tendon. In this manner, it is possible to arrange individual tendon rings with smaller spacing from one another than would be possible if it was necessary to provide anchoring or connecting devices in each turn, since such devices require more space than the tendons themselves.

To provide temporary corrosion protection, the inner surfaces of the steel tube can be covered with a coat of paint or zinc-plated. In addition, the strands can be temporarily protected against corrosion by grease, oil or a coating of epoxy resin. Durable corrosion protection is obtained by injecting grout or a cement paste and the corrosion protection is further increased by the steel tubes used as sheathing ducts or is also assured at the points which are not completely enclosed after the grouting operation.

In such a method, large size tendons can be pulled in carefully up to a radius of approximately 5 meters and they can also be prestressed by transverse compression without essentially lowering their load-carrying capacity. The well-known blocking points caused by the low coefficients of friction which often lead to non-uniform prestressing distribution in the individual strands are also largely eliminated.

The prestressing of the tendons 12 occurs in the spherically-shaped pressure vessel 9, as described above, by the pressure of the medium within the vessel, for instance by filling the sphere with air or gas. The joints 11 have to bridged over in a sealing manner for this purpose. In FIGS. 4 and 5, the sealing action is provided by an inner wall 21 against which a liner or similar member rests. Hydraulic presses 22 are required for controlling the uniform opening of the joint, as well as forming support for appliances arranged in the joint, but not illustrated. The presses also fix or immobilize the spherical segments in position, in case there is an unexpected pressure drop. After the desired prestress in the tendons has been achieved, the joints 11 are filled with concrete. Subsequently, if the pressure of the medium within the container or vessel 9 is relieved, the prestressing on the tendons acts as a pressure preload on the vessel shell.

While specific embodiments of the invention have been shown and described in detail to illustrate the application of the inventive principles, it will be understood that the invention may be embodied otherwise without departing from such principles.

I claim:

1. Method of inserting axially elongated steel tendons, such as tendons in the form of strands or bundles of strands of steel wire into tendon ducts located in a concrete structural member wherein the tendon ducts include encasing elongated sheathing ducts within the concrete of the structural member, wherein the improvement comprises forming recesses in an exterior surface of the structural member and traversing the ducts for affording access within the structural member to the tendon ducts, displacing tendons through the tendon ducts at the recesses and limiting friction on the tendons during displacement by applying directly to the tendons in the recesses at least one of forces in the axial direction of the tendon by using pushing devices for applying forces in the axial direction and locating the pushing devices in the recesses in the structural member and vibration forces acting transversely of the axial direction of the tendons by using vibrators for applying the vibration forces to the tendons and locating the vibrators within the recesses in the structural member.

2. Method, as set forth in claim 1, wherein the method further comprises the step of using continuously prebent steel tubes as the sheathing ducts for the tendons for lowering the friction of the tendons conducted at least one of around large reversing angles and small radius bends.

3. Method, as set forth in claim 2, wherein coating the inside surface of the steel tube with at least one of a friction reducing material and a corrosion preventing material.

4. Method, as set forth in claim 1, wherein coating the tendon with at least one of a friction reducing material and a corrosion-preventing material.

5. Method, as set forth in claim 1, wherein forming the sheathing ducts as continuous 360° turns or coils, and displacing the tendon through at least two of the 360° turns, and applying at least one of the axially directed forces and the vibration forces at a plurality of locations in the recesses.

6. Method, as set forth in claim 5, wherein anchoring the inserted tendons at the ends thereof within said structural member at anchorage locations, and connecting adjoining ends of the tendons at the anchor locations.

7. Method, as set forth in claim 1, wherein the structural member is a hollow spherically shaped tank and the method further comprises the steps of forming the recesses extending along intersecting great circles of the spherically shaped tank, forming the sheathing ducts as continuous turns or coils, and applying forces from pushing devices and vibrations from vibrators located at space positions along the sheathing ducts for displacing the tendon through at least two of the 360° turns.

* * * * *